United States Patent [19]

Isakov

[11] Patent Number: 4,716,976

[45] Date of Patent: Jan. 5, 1988

[54] ROTARY PERCUSSION DRILL BIT

[75] Inventor: Edmund Isakov, Latrobe, Pa.

[73] Assignee: Kennametal Inc., Latrobe, Pa.

[21] Appl. No.: 924,528

[22] Filed: Oct. 28, 1986

[51] Int. Cl.[4] ..... E21B 10/36; E21B 10/38

[52] U.S. Cl. ..... 175/410; 175/415; 175/418; 175/419

[58] Field of Search ..... 175/419, 420, 415, 410, 175/414, 418, 389, 336

[56] References Cited

U.S. PATENT DOCUMENTS

| | | | |
|---|---|---|---|
| 1,098,795 | 6/1914 | Gill . | |
| 1,483,296 | 2/1924 | Gill . | |
| 2,689,109 | 9/1954 | Curtis | 175/410 |
| 2,776,819 | 1/1957 | Brown | 175/419 UX |
| 2,815,932 | 12/1957 | Wolfram | 175/288 |
| 3,269,469 | 8/1966 | Kelly, Jr. | 175/336 |
| 3,294,186 | 12/1966 | Buell | 175/410 |
| 3,519,092 | 7/1970 | Miller | 175/418 X |
| 3,618,683 | 11/1971 | Hughes | 175/410 |
| 4,026,372 | 5/1977 | Hampson | 175/419 X |
| 4,181,187 | 1/1980 | Lumen | 175/410 |
| 4,294,319 | 10/1981 | Guergen | 175/389 |
| 4,397,361 | 8/1983 | Langford, Jr. | 175/329 |
| 4,527,641 | 7/1985 | Klemm | 175/92 |
| 4,572,307 | 2/1986 | Tunell | 175/410 |
| 4,598,779 | 7/1986 | Liljekvist et al. | 175/410 |

OTHER PUBLICATIONS pp. 134 & 156 of a book in Russian by G. V. Artsimovich, E. P. Poladllo, and I. A. Sveshnikov, entitled "Research and Development of Rock-Destructive Tools for Drilling" (Izdatel'stvo Navka, Novosibirsh, 1980).

*Primary Examiner*—Stephen J. Novosad
*Attorney, Agent, or Firm*—John J. Prizzi

[57] ABSTRACT

A rotary percussion rock drill bit has a body and a symmetrical cross-like arrangement of crushing and cutting inserts secured on the body. The bit body has a rearward shank portion and a forward boring head portion with a front face. The cylindrical crushing inserts are secured in the forward head portion and have noncutting hemispherical rock crushing ends exposed at the front face of the head portion. The cutting inserts, which can be rectangular or cylindrical in shape, are secured in the forward head portion and have roof-shaped ends exposed at the front face of the head portion. A peak of each roof-shaped end defines a rock cutting edge. The crushing and cutting inserts are arranged on the head portion with their respective hemispherical and roof-shaped ends in a symmetrical cross-like pattern. The bit body also has a longitudinal central axis, and the crushing and cutting inserts are aligned along planes disposed in orthogonal relation to one another and intersecting at the central axis. At least one crushing insert is disposed on each opposite side of the central axis along one of the planes, whereas at least one cutting insert is disposed on each opposite side of the central axis along the other of the planes. The cutting edge of each of the cutting inserts extends generally parallel to and offset from the plane along which the cutting inserts are aligned.

10 Claims, 14 Drawing Figures

ROTARY PERCUSSION DRILL BIT

BACKGROUND OF THE INVENTION

1. Field of the Invention

The present invention relates generally to rock drill bits and, more particularly, in concerned with a rotary percussion drill bit having a plurality of button-like cylindrical crushing inserts arranged in a symmetrical cross-like pattern with a plurality of offset-edged cutting inserts for improved performance of rock crushing and cutting operations.

2. Description of the Prior Art

Many different shapes of bits and inserts therefor are used in rock drilling applications. However, generally speaking, the different shaped bits and inserts are used for one or another of three basic types of drilling: rotary, percussion (or impact), and rotary percussion (or rotary impact). Rotary drilling is performed by rotating the bit at a given rpm (for instance, 100 to 400) and torque (50 to 150 ft-lbs) with a gradually increased thrust (minimal 1,500 lbs; maximum 10,000 lbs). Percussion drilling is performed by using pneumatic or hydraulic power to drive the bit in a reciprocatory manner at an impact frequency which can reach 2000 impacts per minute or more. Normally, in percussion drilling the drill bit is rotated or indexed a few degrees after each impact. Rotary percussion drilling is performed by reciprocally driving the bit to crush the rock and create micro cracks therein and rotating the bit to cut the cracked rock.

Representative of the prior art drill bits used in one or another of the three basic types of drilling are those disclosed in U.S. Pat. Nos. to Gill (1,098,795; 1,483,296), Curtis (2,689,109), Wolfram (2,815,932), Kelly, Jr. (3,269,469), Buell (3,294,186), Huges (3,618,683), Lumen (4,181,187), Guergen (4,294,319), Langford, Jr. (4,397,361), Klemm (4,527,641), Tunell (4,572,307) and Liljekvist et al (4,598,779). Also, other prior art drill bits are disclosed on pages 134 and 156 of a book in Russian by G. V. Artsimovich, E. P. Poladko, and I. A. Sveshnikov entitled "Reasearch and Development of Rock-Destructive Tools for Drilling" (Izdatel'stvo "Nauka", Novosibirsk, 1978). While many of the aforecited drill bits would appear to operate reasonably well under the limited range of operating conditions for which they were designed, there is a continuing need for advances in rock drilling bit design which will improve the productivity and extend the life of bits and thereby reduce drilling costs.

SUMMARY OF THE INVENTION

The present invention provides a rotary percussion drill bit designed to satisfy the aforementioned needs. The drill bit of the present invention combines a plurality of button-like cylindrical crushing inserts in a symmetrical cross-like pattern with a plurality of offset-edged cutting inserts for improved performance of rock crushing and cutting operations in boring holes in rock.

Accordingly, the present invnetion is directed to a drill bit, comprising: (a) a body having a rearward shank portion and a forward boring head portion with a front face; (b) a plurality of cylindrical crushing inserts secured in the forward boring head portion and having noncutting rock crushing ends exposed at the front face thereof; and (c) a plurality of cutting inserts secured in the forward head portion and having roof-shaped ends exposed at the front face thereof with a peak of each the roof-shaped ends defining a rock cutting edge; (d) the crushing and cutting inserts being arranged on the head portion with their respective hemispherical and roof-shaped ends in a symmetrical cross-like pattern.

Still further, the bit body has a longitudinal central axis, and the crushing and cutting inserts are aligned along planes disposed in orthogonal relation to one another and intersecting at the central axis. Also, at least one crushing insert is disposed on each opposite side of the central axis along one of the planes with the axis of the cylindrical crushing insert lying in the plane. Similarly, at least one cutting insert is disposed on each opposite side of the central axis along the other of the planes. However, the cutting edge of each cutting insert extends generally parallel to but offset from the plane along which the cutting inserts are aligned. The cutting edge of the cutting insert on one opposite side of the central axis is offset from the plane in an opposite direction from that in which the cutting edge of the cutting insert on the other opposite side of the central axis is offset from the plane.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
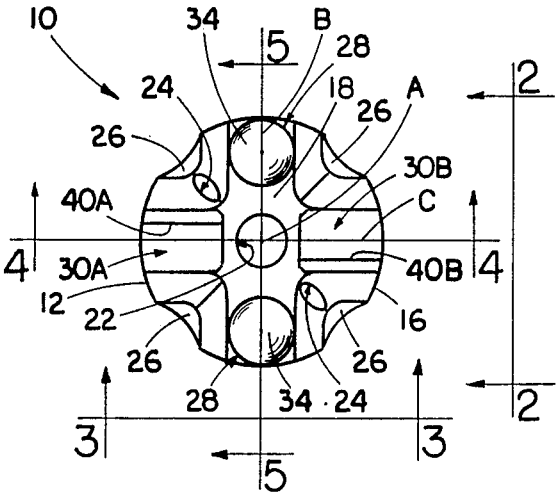
FIG. 1 is a top plan view of a first embodiment of the rotary percussion drill bit of the present invention.
Figure 2:
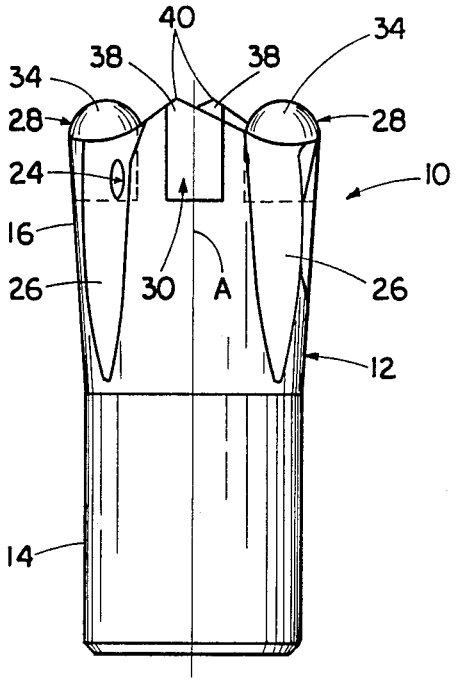
FIG. 2 is a side elevational view of the first embodiment of the bit as seen along line 2—2 of FIG. 1.
Figure 3:
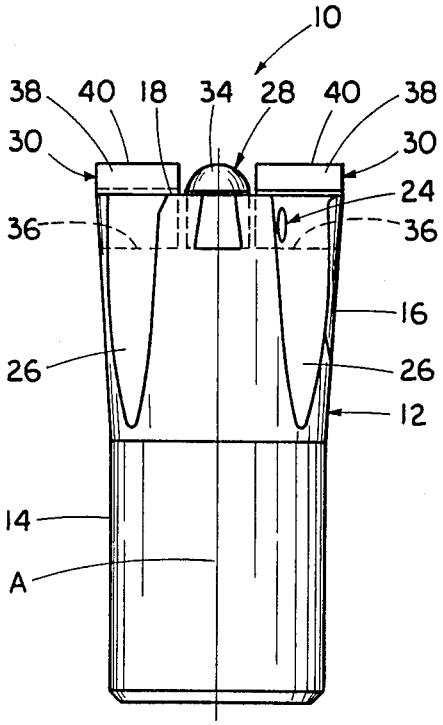
FIG. 3 is another side elevational view of the first embodiment of the bit as seen along line 3—3 of FIG. 1.
Figure 4:
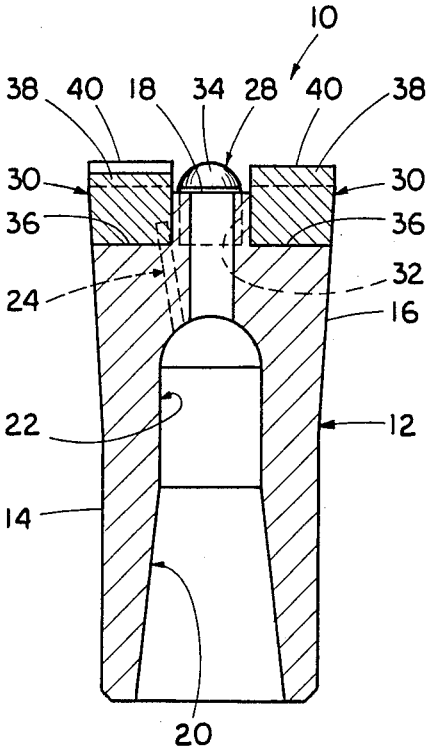
FIG. 4 is a longitudinal axial sectional view of the first embodiment of the bit taken along line 4—4 of FIG. 1.
Figure 5:
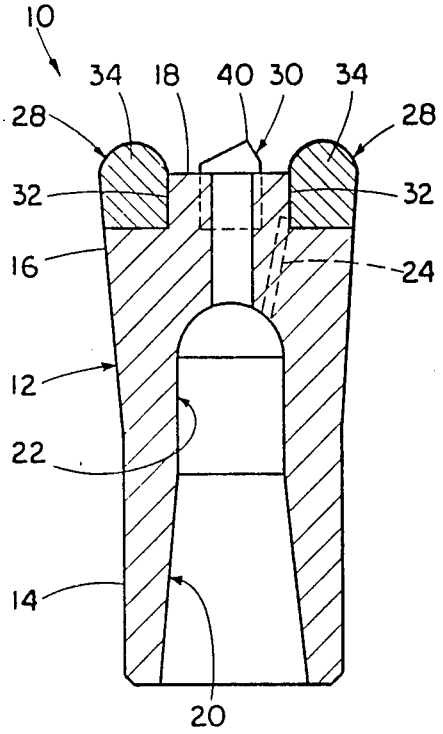
FIG. 5 is another longitudinal axial sectional view of the first embodiment of the bit taken along line 5—5 of FIG. 1.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIGS. 1 to 5, there is shown the first embodiment of the rotary percussion rock drill bit of the present invention, being generally designated 10. The drill bit 10 includes a generally cylindrical body 12 having a rearward shank portion 14 and a forward boring head portion 16 with a front face 18. A tapered interior socket 20 is defined within the rearward shank portion 14 of the bit 10 for attaching the bit to a drilling apparatus (not shown). In the alternative, the interior socket of the shank portion 14 may be internally threaded. Also, the bit 10 has a longitudinal central axis A extending through the shank and head portions 14,16 of the bit body 12.

For flushing out the bit 10, center and side passages 22,24 are defined in the bit body 12. The center flushing passage 22 extends through the head portion 16 of the bit body 12 in coaxial relationship to its central axis A, interconnecting the interior socket 20 with the front face 18 of the bit 10. The side passages 24 are angularly displaced 180 degrees from each other, extend at an acute angle relative to the central axis A and interconnect the center passage 22 and the front face 18 of the bit head portion 16. In the flushing process, a liquid or air is forced out through the center passage 22 and therefrom out the side passages 24 to wash away material, chips, etc., and to cool the bit 10. Further, the bit 10 has cutout or relief areas 26 spaced approximately 90 degrees from one another about the periphery of its head portion 16 which allow chip flow or removal during the drilling operation.

In accordance with the present invention, the drill bit 10 has a plurality of rock crushing inserts 28 and rock cutting inserts 30 which perform concurrent rock crushing and cutting operations as the bit is reciprocated and rotated relative to the rock body being drilled by the bit. The crushing inserts 28 are preferably in the form of cylindrical blocks secured in cylindrical bores 32 formed in the bit body head portion 16 and located 180 degrees from one another. The crushing inserts 28 are attached to the head portion 16 by any suitable method, such as being brazed thereto. Each cylindrical crushing insert 28 has an upper noncutting hemispherical-shaped rock crushing end 34 which is exposed at the front face 18 of the bit body head portion 16.

The cutting inserts 30 are preferably in the form of elongated rectangular blocks secured in elongated rectangular slots 36 formed in the bit body head portion 16 and located 180 degrees from one another. The cutting inserts 30 are attached to the head portion 16 by any suitable method, such as being brazed thereto. Each rectangular cutting insert 30, commonly referred to as a log cabin design, has a roof-shaped end 38 exposed at the front face 18. Each roof-shaped end 38 has a peak defining a rock cutting edge 40.

The bit body 12 is preferably constructed from a steel alloy material, whereas preferably the inserts 28,30 are made from a harder material, such as tungsten carbide. After fabrication, the peripheral side of the head portion 16 of the bit 10 is ground off to produce a slight reverse taper which provides a rake or relief angle therearound and exposes the carbide inserts at the side of the bit as well as at its front face 18.

The crushing and cutting inserts 28,30 of the drilling bit 10 are arranged on the forward boring head portion 16 with their respective hemispherical and roof-shaped ends 34,38 in a symmetrical cross-like pattern. That is, the crushing and cutting inserts 28,30 are aligned along planes B and C which are disposed in orthogonal relation to one another and intersect at the central axis A. In the first embodiment of FIGS. 1 to 5, one crushing insert 28 is disposed on each opposite side of the central axis A along the one plane B. Each cylindrical crushing insert has an axis which lies in the one plane B. Similarly, one cutting insert 30 is disposed on each opposite side of the central axis A along the other plane C. The cutting edge 40 of each cutting insert 30 extends generally parallel to but is offset from the plane C along which each of the cutting inserts is aligned. As seen in FIG. 1, the cutting edge 40A of the cutting insert 30A on one opposite side of the central axis A is offset from the plane C in an opposite direction from that in which the cutting edge 40B of the cutting insert 30B on the other opposite side of the central axis A is offset from the same plane C.

Second and third embodiments of the drill bit of the present invention as shown respectively in FIGS. 6 to 8 and 9 to 14. Parts similar to those of the bit 10 in FIGS. 1 to 5 are identified by the same reference numeral preceded by a "1" with respect to the second embodiment and a "2" with respect to the third embodiment. Only the main differences of the second and third embodiments from the first embodiment will be described hereafter.

Figure 6:
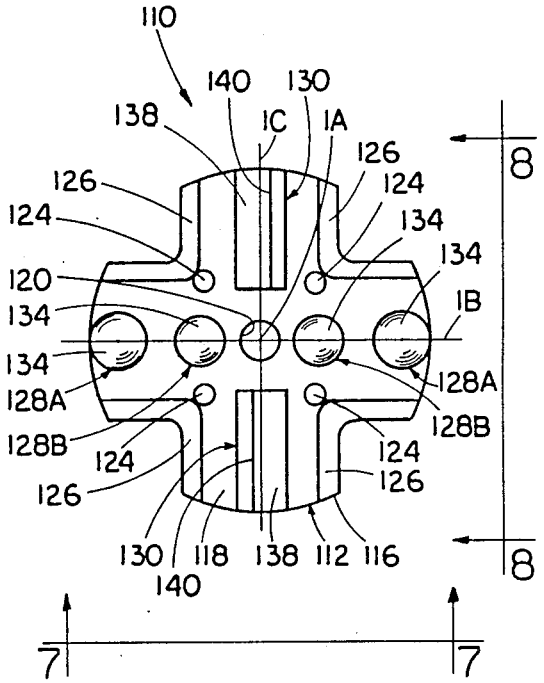
FIG. 6 is a top plan view of a second embodiment of the rotary percussion drill bit of the present invention.
Figure 8:
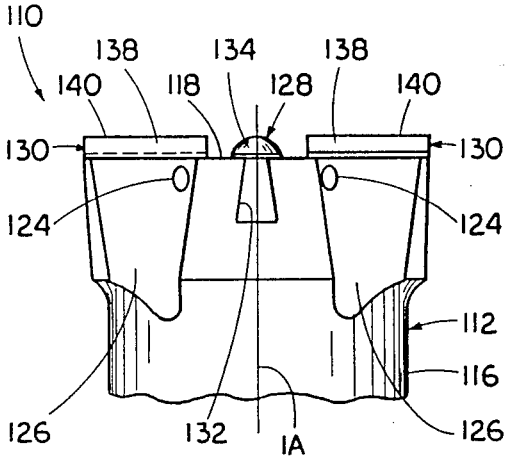
FIG. 8 is another side elevational view of a fragmentary upper portion of the second embodiment of the bit as seen along line 8—8 of FIG. 6.
Figure 7:
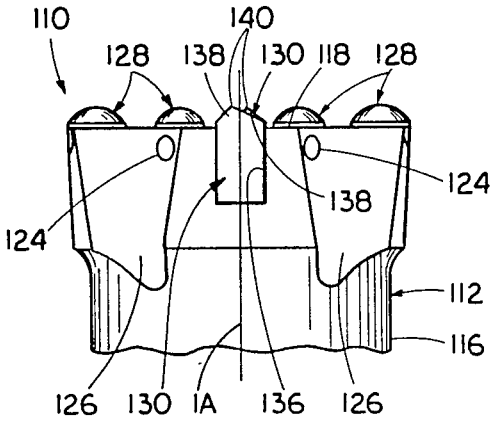
FIG. 7 is a side elevational view of a fragmentary upper portion of the second embodiment of the bit as seen along line 7—7 of FIG. 6.

In the second embodiment of FIGS. 6 to 8, the drill bit 110 is larger in diameter than drill bit 10 so as to accommodate two tandemly-arranged crushing inserts 128 disposed on each opposite side of the central axis 1A along the one plane 1B. The inserts 128 on each side are of different diameters; however, they can also be of the same diameter, or the outer insert 128A can have a larger diameter than the inner insert 128B. Also, the cutting inserts 130 in the second embodiment are longer than those in the first embodiment. Further, there are four instead of two side flushing passages 124.

Figure 9:
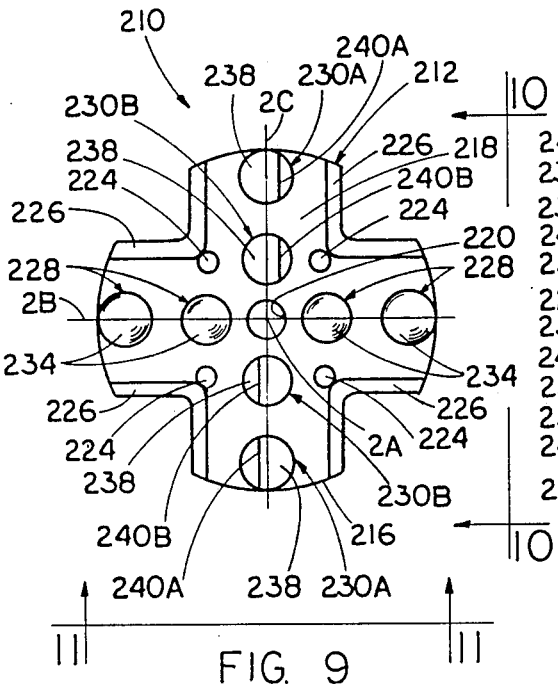
FIG. 9 is a top plan view of a third embodiment of the rotary percussion drill bit of the present invention.
Figure 10:
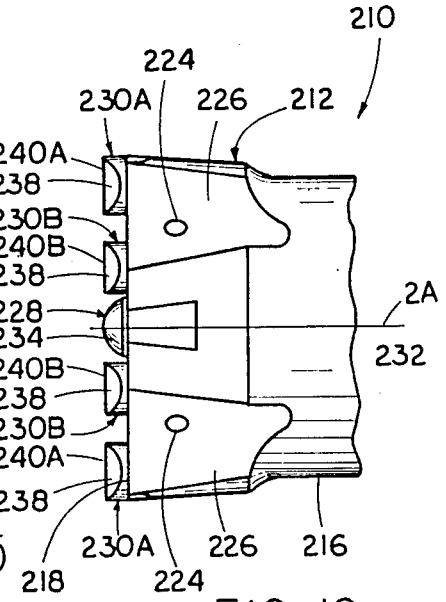
FIG. 10 is a side elevational view of a fragmentary upper portion of the third embodiment of the bit as seen along line 10—10 of FIG. 9.
Figure 11:
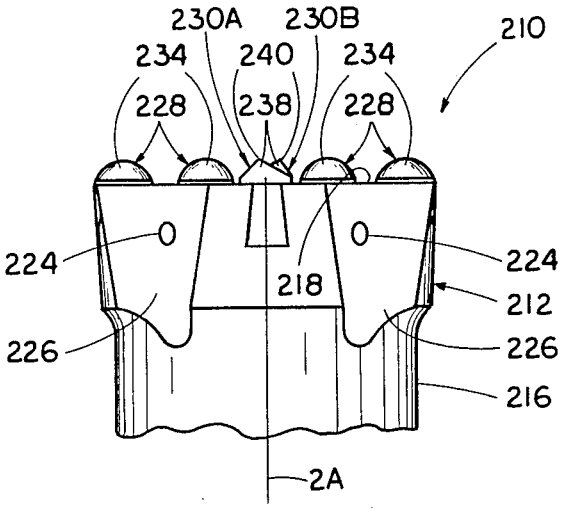
FIG. 11 is another side elevational view of a fragmentary upper portion of the third embodiment of the bit as seen along line 11—11 of FIG. 9.
Figure 12:
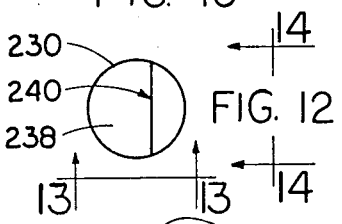
FIG. 12 is a top plan view of one of the cutting inserts of the bit of FIG. 9 with the insert removed from the bit.
Figure 13:
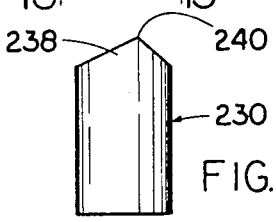
FIG. 13 is a side elevational veiw of the cutting insert as seen along line 13—13 of FIG. 12.
Figure 14:
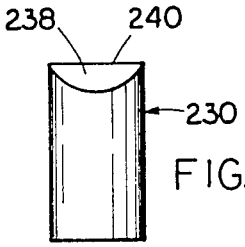
FIG. 14 is another side elevational view of the cutting insert as seen along line 14—14 of FIG. 12.

In the third embodiment of FIGS. 9 to 14, again, the drill bit 210 is larger in diameter than the drill bit 10 for accommodating two tandemly-arranged crushing inserts 228 disposed on each opposite side of the central axis 2A along the one plane 2B, which inserts 228 are substantially identical to the inserts 128 of the second embodiment. However, the main difference of the third embodiment from both the first and second embodiments is that there are two cutting inserts 230A, 230B, which are in the form of cylindrical blocks, disposed on each opposite side of the central axis 2A along the other plane 2C. However, similar to each cutting insert 30 of the first embodiment, each cutting insert 230 of the third embodiment has a roof-shaped end 238, but which is now circular, with a peak defining a cutting edge 240 which extends generally parallel to but is offset from the plane 2C along which each of the cutting inserts 230 is aligned. As seen in FIG. 9, the cutting edges 240A of the cutting inserts 230A on one opposite side of the central axis 2A are offset from the plane 2C in an opposite direction from that in which the cutting edges 240B of the cutting inserts 230B on the other opposite side of the central axis 2A are offset from the same plane 2C.

The advantages of the cylindrical cutting insert over the rectangular one is that it has better compressive strength and less residual stress and thus it should wear less. In the case of the rectangular log cabin insert design, the larger the diameter of the bit the longer this insert has to be. But the longer the insert, the weaker it becomes. Thus, there is an advantage to the substitute of two or more cylindrical cutting inserts in place of a single long rectangular one. Multiple cylindrical cutting inserts also provide a cutting edge with a serrated cutting profile which is advantageous over a continuous cutting edge.

It will be observed that in all embodiments the upper edges of all crushing and cutting inserts lie in a common plane extending transversely with relation to the central axis of the bit. Also, all embodiments of the cutting inserts should have a clearance angle of about twenty to thirty degrees, preferably twenty-five degrees, and a rake angle of about thirty to forty degrees, preferably thirty-five degrees.

It is thought that the rotary percussion drill bit of the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. In a rock drill bit, the combination comprising:
(a) a body having a rearward shank portion, a forward boring head with a front face and a longitudinal central axis;
(b) a plurality of cylindrical crushing inserts secured in said forward boring head portion and having noncutting rock crushing hemispherical shaped ends exposed at said front face thereof; and
(c) a plurality of cutting inserts secured in said forward head portion and having roof-shaped ends exposed at said front face thereof with a peak of each said roof-shaped ends defining a rock cutting edge;
(d) said crushing and cutting inserts being arranged on said head portion with their respective hemispherical and roof-shaped ends in a symmetrical cross-like pattern;
(e) wherein said crushing and cutting inserts are aligned along planes disposed in orthogonal relation to one another and intersecting at said central axis;
(f) and wherein at least two crushing inserts are disposed on each opposite side of said central axis along one of said planes.

2. The drill bit as defined in claim 1, wherein at least one cutting insert is disposed on each opposite side of said central axis along the other of said planes.

3. The drill bit as defined in claim 1, wherein an axis of each cylindrical crushing insert lies in said one plane.

4. The drill bit as defined in claim 1, wherein at least two cutting inserts are disposed on each opposite side of said central axis along the other of said planes.

5. In a rock drill bit, the combination comprising:
(a) a body having a rearward shank portion, a forward boring head with a front face and a longitudinal central axis;
(b) a plurality of cylindrical crushing inserts secured in said forward boring head portion and having noncutting rock crushing hemispherical shaped ends exposed at said front face thereof; and
(c) a plurality of cutting inserts secured in said forward head portion and having roof-shaped ends exposed at said front face thereof with a peak of each said roof-shaped ends defining a rock cutting edge;
(d) said crushing and cutting inserts being arranged on said head portion with their respective hemispherical and roof-shaped ends in a symmetrical cross-like pattern;
(e) wherein said crushing and cutting inserts are aligned along planes disposed in orthogonal relation to one another and intersecting at said central axis;
(f) and wherein said cutting edge of each of said cutting inserts extends generally parallel to and offset from said plane along which said each cutting insert is aligned.

6. The drill bit as defined in claim 5, wherein said cutting inserts are generally rectangular in shape.

7. The drill bit as defined in claim 5, wherein said cutting inserts are generally cylindrical in shape.

8. The drill bit as defined in claim 5, wherein at least one cutting insert is disposed on each opposite side of said central axis, said cutting edge of said cutting insert on one opposite side of said central axis being offset from said plane in an opposite direction from that in which said cutting edge of said cutting insert on the other opposite side of said central axis is offset from said plane.

9. The drill bit as defined in claim 8, wherein said cutting inserts are generally rectangular in shape.

10. The drill bit as defined in claim 8, wherein said cutting inserts are generally cylindrical in shape.

* * * * *